US008664505B2

(12) United States Patent
Castres et al.

(10) Patent No.: US 8,664,505 B2
(45) Date of Patent: Mar. 4, 2014

(54) METHOD FOR SYNCHRONIZING AT LEAST ONE MULTIMEDIA PERIPHERAL OF A PORTABLE COMMUNICATION DEVICE WITH AN AUDIO FILE, AND CORRESPONDING PORTABLE COMMUNICATION DEVICE

(75) Inventors: Christophe Castres, Parisis (FR); Minh Le, Neuilly sur Seine (FR); Michael Guilbaud, Toulouse (FR); Muriel Gohn, Chatou (FR)

(73) Assignee: DRNC Holdings, Inc., Wilmington, DE (US)

( * ) Notice: Subject to any disclaimer, the term of this patent is extended or adjusted under 35 U.S.C. 154(b) by 0 days.

(21) Appl. No.: 11/432,728

(22) Filed: May 11, 2006

(65) Prior Publication Data

US 2007/0099603 A1 May 3, 2007

(30) Foreign Application Priority Data

May 12, 2005 (EP) ..... 05300374

(51) Int. Cl.
*G10H 7/00* (2006.01)

(52) U.S. Cl.
USPC ..... 84/645; 84/611

(58) Field of Classification Search
USPC ..... 84/645, 611
See application file for complete search history.

(56) References Cited

U.S. PATENT DOCUMENTS

| | | | | |
|---|---|---|---|---|
| 2002/0025838 | A1* | 2/2002 | Kawamura | 455/567 |
| 2003/0114150 | A1 | 6/2003 | Hayashi | 455/418 |
| 2003/0221544 | A1* | 12/2003 | Weissflog | 84/667 |
| 2005/0070241 | A1* | 3/2005 | Northcutt et al. | 455/265 |

FOREIGN PATENT DOCUMENTS

| | | |
|---|---|---|
| EP | 1172796 | 2/2000 |
| JP | 09191333 | 7/1997 |
| JP | 2001320447 | 5/2000 |

OTHER PUBLICATIONS

European Search Report—Sep. 30, 2005.

* cited by examiner

*Primary Examiner* — Jeffrey Donels
(74) *Attorney, Agent, or Firm* — Frank Linguiti

(57) ABSTRACT

A method for synchronizing a number R greater than or equal to 1 of multimedia peripherals (6) of a portable communication device with an audio file (1), comprising the steps of extracting a number P greater than or equal to 1 of basic synchronization signals ($SYNC_i$) according to a first set of parameters (20); generating, from said P basic synchronization signals, a number Q greater than or equal to 1 of synchronization command signals ($COM_k$) according to a second set of parameters (30) defining rules to convert basic synchronization signals into signals adapted to the type of peripheral to be synchronized; and selecting, among said Q synchronization command signals, R synchronization signals ($P_{SYNCk}$) for controlling R peripheral drivers (5) driving said R multimedia peripherals (40), according to a third set of parameters (40).

23 Claims, 3 Drawing Sheets

METHOD FOR SYNCHRONIZING AT LEAST ONE MULTIMEDIA PERIPHERAL OF A PORTABLE COMMUNICATION DEVICE WITH AN AUDIO FILE, AND CORRESPONDING PORTABLE COMMUNICATION DEVICE

RELATED APPLICATION

This application is related to and claims the benefit of priority from European Patent Application No. 05 300 374.5, filed on May 12, 2005, the entirety of which is incorporated herein by reference.

FIELD OF THE INVENTION

The present invention relates to a method for synchronizing at least one multimedia peripheral of a portable communication device, such as a mobile phone, with an audio file.

BACKGROUND

The wording "multimedia peripherals" relates here to the different parts of the portable communication which can be activated in synchronization with music, for instance, in case of a mobile phone:

- the ringer for alerting a user in case of reception of an incoming call or a message;
- vibrator means which might be used either instead of or combined with the ringing;
- the backlighting which is used for illuminating the display;
- the backlighting used for illuminating one or several keys on the keypad;
- Any dedicated illuminating devices such as leds which could be provided on the mobile phone.

Providing a portable communication device, such as a mobile phone, with means to synchronize one peripheral multimedia, as defined hereinabove by way of non-limitative examples, with an audio file, is already known. Audio files can be either synthetic or natural audio files.

Synthetic audio files relate to all kinds of files which contain numeric data enabling a synthesizer to generate a music or melody, such as the standardized files known as MIDI (Acronym for Musical Instrument Digital Interface), or SP-MIDI, or SMAF (Acronym for Synthetic music Mobile Application Format). More precisely, MIDI files do not contain any sound. They are in fact text files, containing encoded commands which enable a synthesizer to play notes. Numbers specify each note's position relative to the start of the music and its time-value, and its volume, including Crescendos and Diminuendos. Other commands set the instrument (e.g. 1=Grand Piano, 74=Flute) for each track/channel, the Tempo changes and the overall volume and stereo balance per track.

Generally, the synthetic files used for this particular application are specific as they contain a particular instrument which is to be used for synchronizing one peripheral multimedia, for instance instrument 125 in case of the ringing tone, or instrument 12 in case of the vibrator the ringer of the mobile phone. These specific synthetic files can be loaded in the memory of the mobile phone at the time of manufacturing. Alternatively, the user can download new synthetic files, either via the cellular network to which the mobile phone is affiliated, or via any type of networks including Internet, or from a PC. Once these files have been downloaded and stored in the memory of the mobile phone, the user has generally the possibility, via a specific menu, to choose the file which can be used for synchronizing each multimedia peripheral provided in its mobile phone.

Natural audio files are for instance MP3 or AAC (Advanced Audio Coding) files, for which decoding means, linked to loudspeakers, are needed for playing the files.

In the prior art solutions however, no solution enables a user to synchronize one or several multimedia peripherals of its mobile phone from an audio file, whatever the type (natural or synthetic) of audio file, and whatever the content of this audio file. Consequently, the choice for the user is generally limited to what manufacturers or networks operators or service providers propose, which does not always match with the users preferences.

In addition, peripherals to be synchronized are limited to a vibrator and a led, and synchronization signals generally correspond to a basic switch on or off of the peripheral in correspondence with the extracted synchronization parameters (proprietary audio file format only). This means that some audio files will not be adapted in some cases for activating a particular type of peripherals

OBJECTS AND SUMMARY

The aim of the invention is to remedy the above drawbacks by proposing a solution enabling to systematically synchronize at least a multimedia peripheral, whatever the type of peripheral, with information coming from any type of audio file (natural or synthetic), whatever the content of this audio file, and especially even in case in which no synchronization information is contained in this audio file.

To this aim, an object of the present invention is to provide a method for synchronizing, with an audio file, a number R greater than or equal to 1 of multimedia peripherals of a portable communication device, comprising the following steps:

- Extracting from said audio file a number P greater than or equal to 1 of basic synchronization signals according to a first set of parameters;
- Generating, from said P basic synchronization signals, a number Q greater than or equal to 1 of synchronization command signals according to a second set of parameters defining rules to convert basic synchronization signals into signals adapted to the type of peripheral to be synchronized;
- Selecting, among said Q synchronization command signals, R synchronization signals for controlling R peripheral drivers driving said R multimedia peripherals, according to a third set of parameters.

Consequently, it becomes possible to create different customizable synchronizations based on any type of audio sources and depending on the peripheral that is addressed.

According to one possible embodiment of the invention, said audio file is a synthetic audio file, and said first set of parameters comprises at least the number P of said basic synchronization signals and a specific instrument used for synchronization purpose.

Alternatively, said audio file is a synthetic audio file, and that said first set of parameters comprises at least the number P of said basic synchronization signals and a list of preferred instruments.

In this case, said first set of parameters may additionally comprise a priority information for each of said preferred instrument.

Additionally or in combination, said first set of parameters may comprise a frequency threshold and/or a duration threshold and/or a transition threshold between successive notes.

According to another possible embodiment of the invention, said audio file is a natural audio file, said step of extracting comprises a step of computation of a variable representative of the rhythm in said audio file, and said first set of parameters comprises at least the number P of said basic synchronization signals and several predetermined thresholds for comparison with said variable.

In such case, said variable may be a frequency band energy information or an average of the signal power.

Advantageously, said second set of parameters is chosen among the following parameters:

- a frequency division parameter to be applied to a basic synchronization signal in order to generate a synchronization command signal; and/or
- A parameter representing the number of successive impulses inside a basic synchronization signal before the beginning of the generation of a synchronization command signal; and/or
- A parameter representing the number of successive impulses contained in a synchronization command signal.

Advantageously, said sets of parameters can be determined at the time of manufacturing, by memorizing it in the portable communication device, and/or selected by the user via a specific menu.

A second object of the present invention is a portable communication device comprising a number R greater than or equal to 1 of multimedia peripherals, each of which can be activated with synchronism with an audio file, characterized in that it comprises:

- A synchronization extractor for extracting, from said audio file, a number P greater than or equal to 1 of basic synchronization signals according to a first set of parameters;
- A synchronization manager for generating, from said P basic synchronization signals, a number Q greater than or equal to 1 of synchronization command signals according to a second set of parameters defining rules to convert basic synchronization signals into signals adapted to the type of peripheral to be synchronized;
- A mapping manager for selecting, among said Q synchronization command signals, R synchronization signals for controlling R peripheral drivers driving said R multimedia peripherals, according to a third set of parameters.

BRIEF DESCRIPTION OF THE DRAWINGS

Other features and advantages of the invention will become apparent from the following description of embodiments of the invention given by way of non-limiting examples only, and with reference to the accompanying drawings, in which.

DETAILED DESCRIPTION

Figure 1:
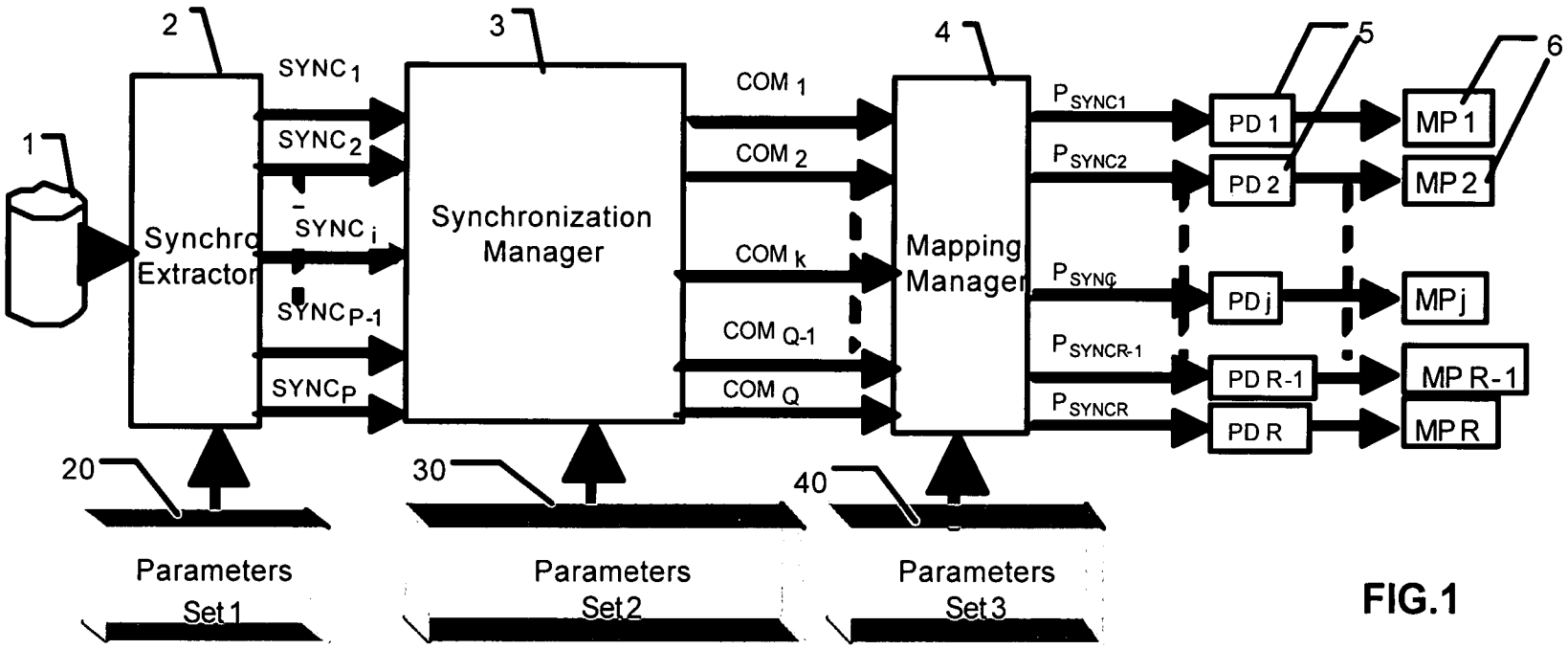
FIG. 1 shows schematically some parts of a portable communication device according to the invention.

In relation with FIG. 1, a portable communication device, such as a mobile phone, is provided with a number R greater or equal to 1 of multimedia peripherals 6 controlled by R corresponding peripherals drivers 5, according to R synchronization signals $P_{SYNCj}$ (for j=[1 . . . R]).

According to the invention, means are provided in the portable device in order to generate these R synchronization signals $P_{SYNCj}$ (for j=[1 . . . R]) starting from any synthetic or natural audio file 1 stored in said portable device. For this purpose, the portable communication device essentially comprises three parts 2, 3, and 4 and three sets of pre stored parameters 20, 30, 40.

More precisely, in a first step of the method according to the invention, a synchronization extractor 2 receives as input said audio file 1, and delivers a number P greater than or equal to 1 of basic synchronization signals $SYNC_i$ (for i=[1 . . . P]). These P basic synchronization are extracted from audio file 1 depending on a first set of parameters 20. This first set of parameters 20 is used to define the kind of information which should be extracted from audio file 1.

For instance, if audio file 1 is a MIDI file, one possible parameter could be a specific instrument of the file usually used for synchronization purpose (namely instrument No. 125). Alternatively or in combination, said first set of parameters could also comprise any existing instrument which can be found in audio file 1, according to a list of preferred instruments. In case several instruments of the preferred list can be found in the audio file, selection of one or several instruments can be specifically chosen depending on other parameters of first set 20 such as:

- the number P of signals which must be extracted; and/or
- priority information for each instrument of the list. For instance, if two instruments of the preferred list are found in audio file 1, preference will be given to instrument with the highest priority information; and/or
- a predetermined frequency threshold. In this case, the frequency apparition of notes for each instrument in said audio files are compared with the frequency threshold, and instruments are chosen depending on the result of comparison; and/or
- a duration threshold. In this case, analysis of the duration of notes is performed for each instrument of the audio file, and only instruments for which the greatest number of notes which duration is superior to the duration threshold has been found are selected; and/or
- a transition threshold between two successive notes. In this case, analysis of transition between two successive notes for each instrument of the audio file is performed, and for instance, only instruments for which transitions are greater than the threshold are selected.

In case audio file 1 is a natural audio file, synchronization extractor 2 will make a computation of a variable representative of the rhythm, such as frequency band energy information, or an average of the signal power. One or several pre determined thresholds will then be used for comparison with said variable, in order to deliver one or several corresponding basic synchronization signals depending on the comparison result(s). Consequently, in case of a natural audio file, first set of parameters 20 will essentially comprise the number R of signals which must be extracted and the above-mentioned threshold(s).

As can be noticed, this gives to a user a great choice of selection for customization purpose since any type of audio file, whatever the format, and even if this audio file does not contain any dedicated synchronization information, can be used.

Set of parameters 20 can be determined at the time of manufacturing, by memorizing it in the portable communication device. Alternatively or additionally, access to a specific menu can be authorized in order that a user may, at any time, configure a set of parameters of his own choice.

Coming back again to FIG. 1, each basic synchronization signal $SYNC_i$ (for i=[1 . . . P]) output by synchronization extractor 2 is delivered on the inputs of a synchronization manager 3. The aim of synchronization manager 3 is to generate, starting from said P basic synchronization signals $SYNC_i$ (for i=[1 . . . P]), a number Q greater than or equal to 1 of synchronization command signals $COM_k$ (for k=[1 . . . Q]). These Q synchronization command signals are generated depending on a second set of parameters 30. This second set of parameters 30 is used to define rules to convert basic synchronization signals into signals adapted to the type of peripheral to be activated.

In a possible non limitative embodiment, set of parameters 30 comprises:

- a frequency division parameter Div(k)=m, with m being an integer between 1to n. This parameter enables to select, in a basic synchronization signal $SYNC_i$, only one impulse among m successive impulses; and/or
- A parameter Nbimp1(*k*) (for k=[1 . . . Q]) which represents the number of successive impulses inside a basic synchronization signal before the beginning of the generation of a synchronization command signal $COM_k$; and/or
- A parameter Nbimp2(*k*) (for k=[1 . . . Q]) which represents the number of successive impulses contained in a synchronization command signal $COM_k$ Set of parameters 30 can also be determined at the time of manufacturing, by memorizing it in the portable communication device. Alternatively or additionally, access to a specific menu can be authorized in order that a user may, at any time, configure the set of parameters.

Finally, each synchronization command signal $COM_k$ (for k=[1 . . . Q]) output by synchronization manager 3 is delivered on the inputs of a mapping manager 4. The aim of mapping manager 4 is to establish a correspondence between delivered synchronization command signals $COM_k$ (for k=[1 . . . Q]) and peripherals 5, depending on a third set of parameters 40 which gives the mapping table. Here again, set of parameters 40 can be determined at the time of manufacturing, by memorizing it in the portable communication device. Alternatively or additionally, access to a specific menu can be authorized in order that a user may, at any time, configure the set of parameters.

Figure 2:
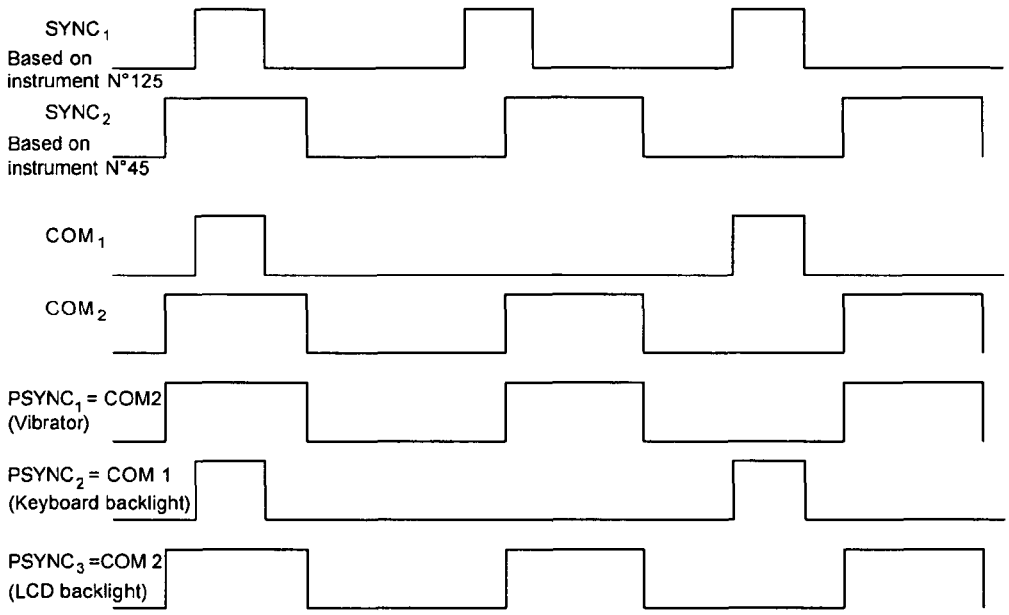
FIG. 2 shows a first example concerning the generation of three synchronization signals from two basic synchronization signals extracted from a MIDI file, for synchronization of a vibrator, a keyboard backlight and a LCD backlight.
Figure 3:
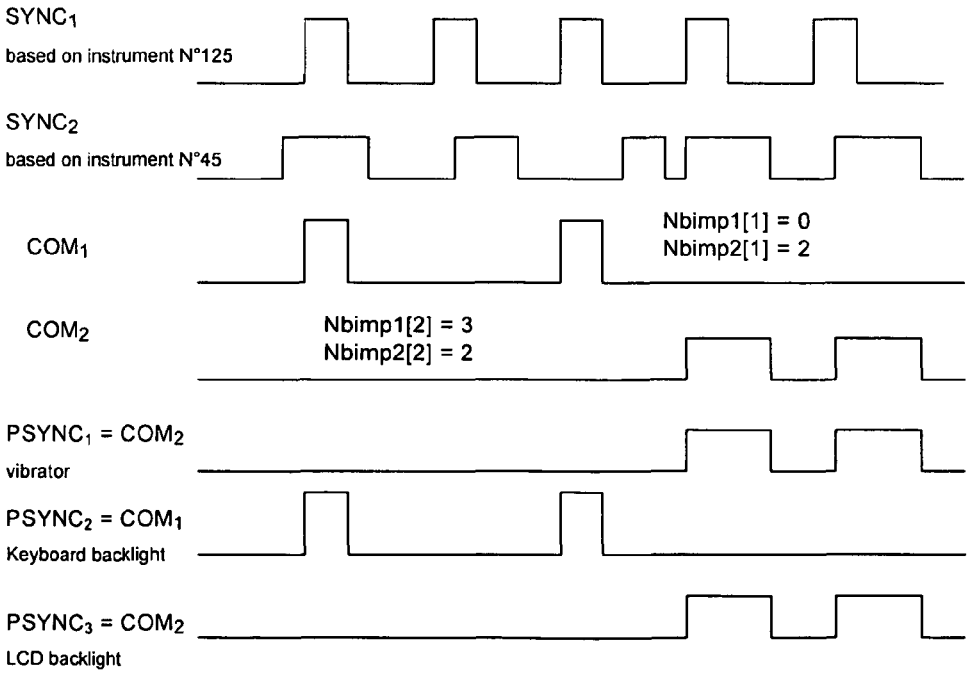
FIG. 3 shows a second example concerning the generation of three synchronization signals from two basic synchronization signals extracted from a MIDI file for synchronization of a vibrator, a keyboard backlight and a LCD backlight.
Figure 4:
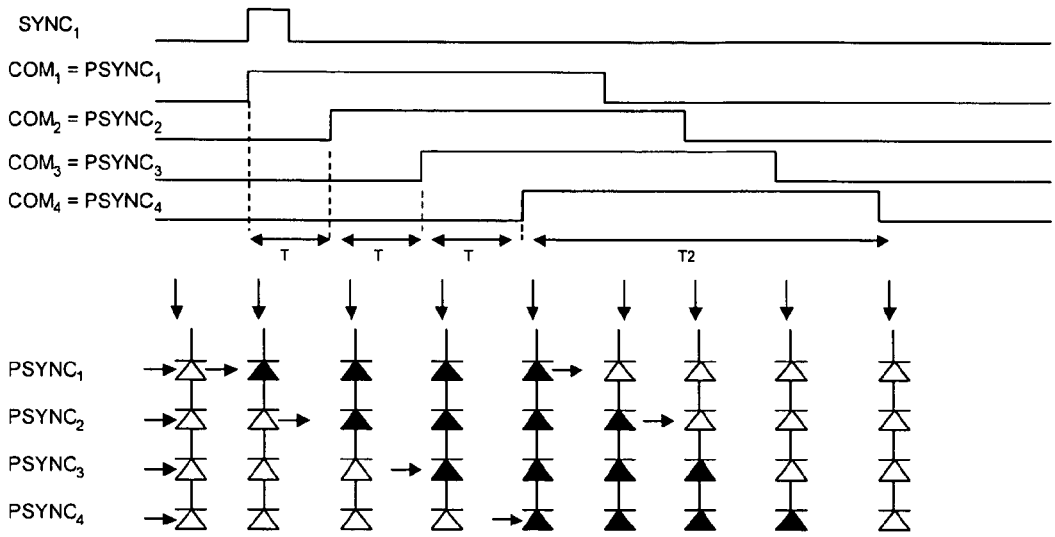
FIG. 4 shows a third example concerning the generation of three synchronization signals from one basic synchronization signal extracted from an audio file, for synchronization of four leds.

FIGS. 2 to 4 give several examples of synchronization generation according to the general principles just explained above:

In the case of FIG. 2, it is assumed that R=3 peripherals are to be synchronized from a synthetic audio, namely:

MP 1=a vibrator;

MP 2=a keyboard backlight; and

MP 3=A LCD backlight.

with the corresponding R=3 synchronization signal $P_{SYNC1}$, $P_{SYNC2}$ and $P_{SYNC3}$.

First set of parameters 20, enabling to extract basic synchronization signals, comprises here the following parameters:

P=2 signals to be output by synchronization extractor 2.

Instruments No. 125 and No. 45 to be extracted from the audio file.

Synchronization manager 3 thus delivers signals $SYNC_1$, and $SYNC_2$.

Second set of parameters 30, enabling to generate Q synchronization command signals, comprises here the following parameters:

Q=2 signals to be output by synchronization manager 3.

Div(1)=2; Nbimp1(1)=0 and Nbimp2(1)=2. This leads to generate a synchronization command signal $COM_1$ which has only two impulsions corresponding to the first and third impulsions of $SYNC_1$.

Div(2)=1; Nbimp1(2)=0 and Nbimp2(3)=3. This leads to generate a synchronization command signal $COM_2$ which has only three impulsions corresponding to the three first impulsions of $SYNC_2$.

At last, third set of parameters 40 gives the following correspondence between peripherals and synchronization signals:

Vibrator must be synchronized with COM2, which means that $P_{SYNC1}=COM_2$;

Keyboard backlight must be synchronized with COM1, which means that $P_{SYNC2}=COM_1$; and LCD backlight must be synchronized with COM2, which means that $P_{SYNC3}=COM_2$ The example of FIG. 3 is quite similar to the example of FIG. 2 since first and third sets of parameters remain the same. However, signals $SYNC_1$ and $SYNC_2$ which are extracted from the audio file have a different shape with comparison to FIG. 2. In addition, second set of parameters 20 comprises here the following parameters:

Q=2 signals to be output by synchronization manager 3.

Div(1)=2; Nbimp1(1)=0 and Nbimp2(1)=2. This leads to generate a synchronization command signal $COM_1$, which has only two impulsions corresponding to the first and third impulsions of $SYNC_1$.

Div(2)=1; Nbimp1(2)=3 and Nbimp2(3)=2. This leads to generate a synchronization command signal $COM_2$ which has only three impulsions corresponding to the three last impulsions of $SYNC_2$ shown on the figure.

FIG. 4 gives a third example wherein four leds are activated in a particular way with synchronism with only one basic synchronization signal $SYNC_1$ extracted from an audio file. In the given example, only one impulse of signal $SYNC_1$ will be converted by Synchronization manager 3 in four signals $COM_1$ to $COM_4$ which will each drive one led in order to have a complex visual effect. On the figure, a black colored led indicates when a led is lighted on. The duration T between the beginning of each signal $COM_k$ and the duration T2 of each impulse of $COM_k$ are parameters set in the second set of parameters 30 used by synchronization manager 3.

It will be understood that synchronization extractor 2, synchronization manager 3 and mapping manager are controlled by the portable communication device's software.

Thanks to the method according to the invention, several multimedia peripherals of a portable communication device can be easily synchronized in a more featured way, without any limitation concerning the audio file sources.

The invention claimed is:

1. A method for synchronizing, with an audio file, one or more multimedia peripherals of a portable communications device, the method comprising:

extracting from the audio file one or more basic synchronization signals according to a first set of parameters that define types of synchronization information to be extracted from the audio file;

generating, from the one or more basic synchronization signals, one or more synchronization command signals according to a second set of parameters that define rules to convert basic synchronization signals into synchronization command signals adapted to types of multimedia peripherals to be synchronized; and selecting, from the one or more synchronization command signals, one or more multimedia peripheral synchronization signals for controlling one or more multimedia peripheral drivers driving the one or more multimedia peripherals.

2. The method of claim 1, wherein the first set of parameters includes a frequency threshold parameter.

3. The method of claim 1, wherein the first set of parameters includes a duration threshold parameter.

4. The method of claim 1, wherein the first set of parameters includes a transition threshold parameter.

5. The method of claim 1, wherein the audio file is a synthetic audio file and the first set of parameters includes an instrument parameter that defines a specific instrument, and wherein, in the step of extracting the basic synchronization signals, if the audio file includes commands for the specific instrument, the instrument parameter is used for synchronizing one of the one or more basic synchronization signals.

6. The method of claim 1, wherein the audio file is a synthetic audio file, and wherein the first set of parameters includes a plurality of instrument parameters and priority information for the plurality of instrument parameters.

7. The method of claim 6, wherein the priority information includes frequency threshold information, the frequency threshold information used to select one or more instrument parameters from among the plurality of instrument parameters used to extract the basic synchronization signals.

8. The method of claim 6, wherein the priority information includes a duration threshold, and wherein the step of extracting the basic synchronization signals includes determining the instruments in the audio file that have the greatest number of notes of duration superior to the duration threshold.

9. The method of claim 6, wherein the priority information includes a transition threshold, and wherein the step of extracting the basic synchronization signals includes determining the instruments in the audio file that have transitions between two successive notes that are greater than the transition threshold.

10. The method of claim 1, wherein the audio file is a natural audio file, and wherein the first set of parameters includes one or more thresholds, and wherein the step of extracting includes computing a variable representative of a rhythm in the audio file and comparing the variable with the thresholds to extract the basic synchronization signals.

11. The method of claim 10, wherein the one or more thresholds of the first set of parameters include frequency band energy information.

12. The method of claim 1, wherein the second set of parameters includes a frequency division parameter used to select one event out of a plurality of events of one of the one or more basic synchronization signals for converting the one of the one or more basic synchronization signals into one of the one or more synchronization command signals.

13. The method of claim 1, wherein the second set of parameters includes a beginning events parameter used to select a number of successive events of one of the one or more basic synchronization signals before the beginning of one of the one or more synchronization command signals.

14. The method of claim 1, wherein the second set of parameters includes a successive events parameter used to select the number of successive events of one of the one or more basic synchronization signals one of the one or more synchronization command signals.

15. A portable communication device having one or more multimedia peripherals, the multimedia peripherals driven by multimedia peripheral drivers activated according to multimedia peripheral synchronization signals, the portable communication device operable to play an audio file, comprising:

a synchronization extractor that extracts, from the audio file, one or more basic synchronization signals according to a first set of parameters that define types of synchronization information to be extracted from the audio file;

a synchronization manager for generating, from the one or more basic synchronization signals, one or more synchronization command signals according to a second set of parameters that define rules to convert basic synchronization signals into synchronization command signals adapted to types of multimedia peripherals to be synchronized; and a mapping manager for selecting, from the one or more synchronization command signals, the one or more multimedia peripheral synchronization signals for controlling the one or more multimedia peripheral drivers.

16. The portable communication device of claim 15, wherein the one or more synchronization command signals includes a plurality of synchronization command signals, and wherein the synchronization manager generates more than one of the plurality of synchronization command signals from one of the one or more basic synchronization signals.

17. The portable communication device of claim 16, wherein a first synchronization command signal of the plurality of synchronization command signals has a first delay between the beginning of the one of the one or more basic synchronization signals and the beginning of the first synchronization command signal and a first duration, and wherein a second synchronization command signal of the plurality of synchronization command signals has a second delay between the beginning of the one of the one or more basic synchronization signals and the beginning of the second synchronization command signal and a second duration, and wherein the first delay, the first duration, the second delay, and the second duration are determined by parameters in the second set of parameters.

18. The portable communication device of claim 15, wherein the one or more multimedia peripheral synchronization signals includes a plurality of multimedia peripheral synchronization signals, and wherein the mapping manager generates more than one of the plurality of multimedia peripheral synchronization signals from one of the one or more synchronization command signals.

19. The portable communication device of claim 15, wherein the one or more multimedia peripherals include at least one of a ringer, a vibrator, a display backlight, a key backlight, and a dedicated light emitting diode (LED).

20. The portable communication device of claim 15, wherein the first set of parameters includes one or more thresholds.

21. The portable communication device of claim 15, wherein the second set of parameters includes a parameter for selecting one or more events out of a plurality of events.

22. The method of claim 1, wherein the first set of parameters includes one or more thresholds.

23. The method of claim 1, wherein the second set of parameters includes a parameter for selecting one or more events out of a plurality of events.

* * * * *